United States Patent [19]

Merchant

[11] Patent Number: 5,066,417

[45] Date of Patent: Nov. 19, 1991

[54] BINARY AZEOTROPIC COMPOSITIONS OF 2,2-DICHLORO-1,2-DIFLUOROETHANE WITH METHANOL, ETHANOL, OR TRANS-1,2-DICHLOROETHYLENE

[75] Inventor: Abid N. Merchant, Wilmington, Del.

[73] Assignee: E. I. Du Pont de Nemours and Company, Wilmington, Del.

[21] Appl. No.: 382,355

[22] Filed: Jul. 20, 1989

[51] Int. Cl.[5] ..... C11D 7/30; C11D 7/50; C23G 5/028; B08B 3/00

[52] U.S. Cl. ..... 252/171; 134/12; 134/31; 134/38; 134/39; 134/40; 203/67; 252/162; 252/170; 252/172; 252/364; 252/DIG. 9

[58] Field of Search ..... 252/162, 170, 171, 172, 252/364, DIG. 9; 203/67; 134/12, 38, 39, 40, 31

[56] References Cited

U.S. PATENT DOCUMENTS

| | | | |
|---|---|---|---|
| 2,999,815 | 9/1961 | Eiseman, Jr. | 252/171 |
| 2,999,816 | 9/1961 | Bennett et al. | 252/171 |
| 2,999,817 | 9/1961 | Bower | 252/172 |
| 3,881,949 | 5/1975 | Brock | 134/31 |
| 3,903,009 | 9/1975 | Bauer et al. | 252/171 |
| 4,131,561 | 12/1978 | Reusser | 252/171 |
| 4,164,471 | 8/1979 | Hutchinson | 252/1 |
| 4,767,561 | 8/1988 | Gorski | 252/171 |
| 4,810,412 | 3/1989 | Merchant | 252/171 |

FOREIGN PATENT DOCUMENTS

| | | |
|---|---|---|
| 304098 | 12/1988 | Japan . |
| 1134356 | 5/1989 | Japan . |
| 1137253 | 5/1989 | Japan . |
| 1140155 | 6/1989 | Japan . |

*Primary Examiner*—Paul Lieberman
*Assistant Examiner*—Linda D. Skaling
*Attorney, Agent, or Firm*—James E. Shipley

[57] ABSTRACT

Azeotropic mixtures of 2,2-dichloro-1,2-difluoroethane (HCFC-132c) with methanol, ethanol, or trans-1,2-dichloroethylene (t-HCC-1130), the azeotropic mixtures being useful in solvent cleaning applications.

10 Claims, No Drawings

BINARY AZEOTROPIC COMPOSITIONS OF 2,2-DICHLORO-1,2-DIFLUOROETHANE WITH METHANOL, ETHANOL, OR TRANS-1,2-DICHLOROETHYLENE

BACKGROUND OF THE INVENTION

As modern electronic circuit boards evolve toward increased circuit and component densities, thorough board cleaning after soldering becomes a more important criterion. Current industrial processes for soldering electronic components to circuit boards involve coating the entire circuit side of the board with flux and thereafter passing the flux-coated board over preheaters and through molten solder. The flux cleans the conductive metal parts and promotes solder fusion. Commonly used solder fluxes generally consist of rosin, either used alone or with activating additives, such as amine hydrochlorides or oxalic acid derivatives.

After soldering, which thermally degrades part of the rosin, the flux-residues are often removed from the circuit boards with an organic solvent. The requirements for such solvents are very stringent. Defluxing solvents should have the following characteristics: a low boiling point, be nonflammable, have low toxicity and have high solvency power, so that flux and flux-residues can be removed without damaging the substrate being cleaned.

While boiling point, flammability and solvent power characteristics can often be adjusted by preparing solvent mixtures, these mixtures are often unsatisfactory because they fractionate to an undesirable degree during use. Such solvent mixtures also fractionate during solvent distillation, which makes it virtually impossible to recover a solvent mixture with the original composition.

On the other hand, azeotropic mixtures, with their constant boiling points and constant compositions, have been found to be very useful for these applications. Azeotropic mixtures exhibit either a maximum or minimum boiling point and they do not fractionate on boiling. These characteristics are also important when using solvent compositions to remove solder fluxes and flux-residues from printed circuit boards. Preferential evaporation of the more volatile solvent mixture components would occur, if the mixtures were not azeotropic and would result in mixtures with changed compositions, and with less-desirable solvency properties, such as lower rosin flux solvency and lower inertness toward the electrical components being cleaned. The azeotropic character is also desirable in vapor degreasing operations, where redistilled solvent is generally employed for final rinse cleaning.

In summary, vapor defluxing and degreasing systems act as a still. Unless the solvent composition exhibits a constant boiling point, i.e., is a single material, or is azeotropic, fractionation will occur and undesirable solvent distributions will result, which could detrimentally affect the safety and efficacy of the cleaning operation.

A number of halocarbon based azeotropic compositions have been discovered and in some cases used as solvents for solder flux and flux-residue removal from printed circuit boards and also for miscellaneous degreasing applications. For example: U.S. Pat. No. 3,903,009 discloses the ternary azeotrope of 1,1,2-trichlorotrifluoroethane with ethanol and nitromethane; U.S. Pat. No. 2,999,815 discloses the binary azeotrope of 1,1,2-trichlorotrifluoroethane and acetone; U.S. Pat. No. 2,999,816 discloses the binary azeotrope of 1,1,2-trichlorotrifluoroethane and methyl alcohol; U.S. Pat. No. 4,767,561 discloses the ternary azeotrope of 1,1,2-trichlorotrifluoroethane, methanol and 1,2-dichloroethylene.

Some of the chlorofluorocarbons which are currently used for cleaning and other applications have been theoretically linked to depletion of the earth's ozone layer. As early as the mid-1970's, it was known that introduction of hydrogen into the chemical structure of previously fully-halogenated chlorofluorocarbons reduced the chemical stability of these compounds. Hence, these now destabilized compounds would be expected to degrade in the lower atmosphere and not reach the stratospheric ozone layer in-tact. What is also needed, therefore, are substitute hydrochlorofluorocarbons which have low theoretical ozone depletion potentials.

Unfortunately, as recognized in the art, it is not possible to predict the formation of azeotropes. This fact obviously complicates the search for new azeotropic compositions, which have application in the field. Nevertheless, there is a constant effort in the art to discover new azeotropes, which have desirable solvency characteristics and particularly greater versatilities in solvency power.

SUMMARY OF THE INVENTION

According to the present invention, an azeotrope has been discovered comprising an admixture of effective amounts of 2,2-dichloro-1,2-difluoroethane with a compound from the group consisting of methanol, ethanol and trans-1,2-dichloroethylene.

More specifically, the azeotropes are: an admixture of about 85–95 weight percent 2,2-dichloro-1,2-difluoroethane and about 5–15 weight percent methanol; an admixture of about 92–98 weight percent 2,2-dichloro-1,2-difluoroethane and about 2–8 weight percent ethanol; and an admixture of about 45–55 weight percent 2,2-dichloro-1,2-difluoroethane and about 45–55 weight percent trans-1,2-dichloroethylene.

The present invention provides nonflammable azeotropic compositions which are well suited for solvent cleaning applications.

DETAILED DESCRIPTION OF THE INVENTION

The composition of the instant invention comprises an admixture of effective amounts of 2,2-dichloro-1,2-difluoroethane ($CFCl_2$-$CH_2F$, boiling point=48.4° C.) with components selected from the group consisting of methanol ($CH_3OH$, boiling point=64.6° C.) or ethanol ($CH_3$-$CH_2OH$, boiling point=78° C.) or trans-1,2-dichloroethylene ($CHCl=CHCl$, boiling point=48.4° C.) to form an azeotropic composition. The halogenated materials are known as HCFC-132c, and t-HCC-1130, respectively, in the nomenclature conventional to the halocarbon field.

By azeotrope is meant, a constant boiling liquid admixture of two or more substances, whose admixture behaves as a single substance, in that the vapor, produced by partial evaporation or distillation of the liquid has substantially the same composition as the liquid, i.e., the admixture distills without substantial compositional change, constant boiling compositions, which are characterized as azeotropes, exhibit either a maximum or minimum boiling point, as compared with that of the nonazeotropic mixtures of the same substances.

For purposes of this invention, consisting essentially of is defined as the amount of each component of the instant invention admixture which, when combined, results in the formation of the azeotropes of the instant invention. This definition includes the amounts of each component, which amounts may vary depending upon the pressure applied to the composition so long as the azeotrope continues to exist at the different pressures, but with possible different boiling points. Therefore, consisting essentially of includes the weight percentage of each component of the compositions of the instant invention, which form azeotropes at pressures other than atmospheric pressure. Consisting essentially of is not intended to exclude the presence of other materials which do not significantly effect the azeotropic nature of the azeotrope.

It is possible to characterize, in effect, a constant boiling admixture, which may appear under many guises, depending upon the conditions chosen, by any of several criteria:

* The composition can be defined as an azeotrope of A and B since the very term "azeotrope" is at once both definitive and limitative, and requires that effective amounts of A and B form this unique composition of matter, which is a constant boiling admixture.

* It is well known by those skilled in the art that at different pressures, the composition of a given azeotrope will vary—at least to some degree—and changes in pressure will also change—at least to some degree—the boiling point temperature. Thus an azeotrope of A and B represents a unique type of relationship but with a variable composition which depends on temperature and/or pressure. Therefore compositional ranges, rather than fixed compositions, are often used to define azeotropes.

* The composition can be defined as a particular weight percent relationship or mole percent relationship of A and B while recognizing that such specific values point out only one particular such relationship and that in actuality, a series of such relationships, represented by A and B actually exist for a given azeotrope, varied by the influence of pressure.

* Azeotrope A and B can be characterized by defining the composition as an azeotrope characterized by a boiling point at a given pressure, thus giving identifying characteristics without unduly limiting the scope of the invention by a specific numerical composition, which is limited by and is only as accurate as the analytical equipment available.

Binary mixtures of about 85–95 weight percent 2,2-dichloro-1,2-difluoroethane and about 5–15 weight percent methanol are characterized as azeotropes, in that mixtures within this range exhibit a substantially constant boiling point at constant pressure. Being substantially constant boiling, the mixtures do not tend to fractionate to any great extent upon evaporation. After evaporation, only a small difference exists between the composition of the vapor and the composition of the initial liquid phase. This difference is such that the compositions of the vapor and liquid phases are considered substantially identical. Accordingly, any mixture within this range exhibits properties which are characteristic of a true binary azeotrope. The binary composition consisting of about 90.5 weight percent 2,2-dichloro-1,2-difluoroethane and about 9.5 weight percent methanol has been established, within the accuracy of the fractional distillation method, as a true binary azeotrope, boiling at about 44.0° C., at substantially atmospheric pressure.

Also, according to the instant invention, binary mixtures of about 92–98 weight percent 2,2-dichloro-1,2-difluoroethane and about 2–8 weight percent ethanol are characterized as azeotropes, in that mixtures within this range exhibit a substantially constant boiling point at constant pressure. Being substantially constant boiling, the mixtures do not tend to fractionate to any great extent upon evaporation. After evaporation, only a small difference exists between the composition of the vapor and the composition of the initial liquid phase. This difference is such that the compositions of the vapor and liquid phases are considered substantially identical. Accordingly, any mixture within this range exhibits properties which are characteristic of a true binary azeotrope. The binary composition consisting of about 94.7 weight percent 2,2-dichloro-1,2-difluoroethane and about 5.3 weight percent ethanol has been established, within the accuracy of the fractional distillation method, as a true binary azeotrope, boiling at about 45.8° C., at substantially atmospheric pressure.

Also, according to the instant invention, binary mixtures of about 45–55 weight percent 2,2-dichloro-1,2-difluoroethane and about 45–55 weight percent trans-1,2-dichloroethylene are characterized as azeotropes, in that mixtures within this range exhibit a substantially constant boiling point at constant pressure. Being substantially constant boiling, the mixtures do not tend to fractionate to any great extent upon evaporation. After evaporation, only a small difference exists between the composition of the vapor and the composition of the initial liquid phase. This difference is such that the compositions of the vapor and liquid phases are considered substantially identical. Accordingly, any mixture within this range exhibits properties which are characteristic of a true binary azeotrope. The binary composition consisting of about 50.2 weight percent 2,2-dichloro-1,2-difluoroethane and about 49.8 weight percent trans-1,2-dichloroethylene has been established, within the accuracy of the fractional distillation method, as a true binary azeotrope, boiling at about 44.5° C., at substantially atmospheric pressure.

The aforestated azeotropes have low ozone-depletion potentials and are expected to decompose almost completely, prior to reaching the stratosphere.

The azeotropes of the present invention permit easy recovery and reuse of the solvent from vapor defluxing and degreasing operations because of their azeotropic natures. As an example, the azeotropic mixtures of this invention can be used in cleaning processes such as described in U.S. Pat. No. 3,881,949, which is incorporated herein by reference.

The azeotropes of the instant invention can be prepared by any convenient method including mixing or combining the desired component amounts. A preferred method is to weigh the desired component amounts and thereafter combine them in an appropriate container.

EXAMPLES

Example 1

A spinning band column was used to discover the existence of the minimum boiling binary azeotropes between 2,2-dichloro-1,2-difluoroethane and methanol.

A solution which contained 74.6 weight percent 2,2-dichloro-1,2-difluoroethane and 25.4 weight percent methanol was prepared in a suitable container and mixed thoroughly.

The solution was distilled in a spinning band column, using a 10:1 reflux to take-off ratio. Head temperatures were adjusted to 760 mm pressure. distillation compositions were determined by gas chromatography. Results obtained are summarized in Table 1.

TABLE 1

| Distillation of: (74.8 + 25.2) 2,2-Dichloro-1,2-difluoroethane (DCFE) and Methanol (MEOH) | | | |
|---|---|---|---|
| Cut. | T, °C. | Percentages | |
| Nos. | Head | DCFE | MEOH |
| 1 | 44.0 | 90.5 | 9.6 |
| 2 | 43.8 | 90.5 | 9.5 |
| 3 | 44.0 | 90.5 | 9.5 |
| 4 | 53.3 | 88.0 | 12.0 |

A statistical analysis of the distillation data indicates the true binary azeotrope of 2,2-dichloro-1,2-difluoroethane and methanol has the following characteristics at atmospheric pressure (99 percent confidence limits):
2,2-Dichloro-1,2-difluoroethane=90.5±1.8 wt.%
Methanol=9.5±0.1 wt.%
Boiling point, °C.=44.0±0.1° C.

EXAMPLE 2

A spinning band column was used to discover the existence of the minimum boiling binary azeotropes between 2,2-dichloro-1,2-difluoroethane and ethanol.

A solution which contained 75.0 weight percent 2,2-dichloro-1,2-difluoroethane and 25.0 weight percent methanol was prepared in a suitable container and mixed thoroughly.

The solution was distilled in a spinning band column, using a 10:1 reflux to take-off ratio. Head temperatures were adjusted to 760 mm pressure. Distillation compositions were determined by gas chromatography. Results obtained are summarized in Table 2.

TABLE 2

| Distillation of: (75.0 + 25.0) 2,2-Dichloro-1,2-difluoroethane (DCFE) and Ethanol (ETOH) | | | |
|---|---|---|---|
| Cut. | T, °C. | Percentages | |
| Nos. | Head | DCFE | ETOH |
| 1 | 46.5 | 94.7 | 5.3 |
| 2 | 45.8 | 94.7 | 5.3 |
| 3 | 45.8 | 94.7 | 5.3 |
| HEEL | — | 37.8 | 62.2 |

A statistical analysis of the distillation data indicates the true binary azeotrope of 2,2-dichloro-1,2-difluoroethane and ethanol has the following characteristics at atmospheric pressure (99 percent confidence limits):
2,2-Dichloro-1,2-difluoroethane=94.7±0.2 wt.%
Ethanol=5.3±0.2 wt.%
Boiling point, °C.=45.8±0.1° C.

EXAMPLE 3

A spinning band column was used to discover the existence of the minimum boiling binary azeotropes between 2,2-dichloro-1,2-difluoroethane and trans-1,2-dichloroethylene. A solution which contained 50.0 weight percent 2,2-dichloro-1,2-difluoroethane and 50.0 weight percent trans-1,2-dichloroethylene was prepared in a suitable container and mixed thoroughly.

The solution was distilled in a spinning band column, using a 10:1 reflux to take-off ratio. Head temperatures were adjusted to 760 mm pressure. distillation compositions were determined by gas chromatography. Results obtained are summarized in Table 3.

TABLE 3

| Distillation of: (50.0 + 50.0) 2,2-Dichloro-1,2-difluoroethane (DCFE) and trans-1,2-Dichloroethylene (TDCE) | | | |
|---|---|---|---|
| Cut. | T, °C. | Percentages | |
| Nos. | Head | DCFE | TDCE |
| 1 | 44.4 | 50.7 | 49.3 |
| 2 | 44.6 | 49.9 | 50.1 |
| 3 | 45.0 | 49.5 | 50.5 |
| HEEL | — | 54.5 | 45.5 |

A statistical analysis of the distillation data indicates the true binary azeotrope of 2,2-dichloro-1,2-difluoroethane and trans-1,2-dichloroethylene has the following characteristics at atmospheric pressure (99 percent confidence limits):
2,2-Dichloro-1,2-difluoroethane=50.2±3.1 wt.%
t-1,2-Dichloroethylene=49.8±2.8 wt.%
Boiling point, °C.=44.5±0.1° C.

EXAMPLE 4

Several single sided circuit boards were coated with activated rosin flux and soldered by passing the board over a preheater to obtain a top side board temperature of approximately 200° F. and then through 500° F. Molten solder. The soldered boards were defluxed separately with the three azeotropic mixtures cited in Examples 1, 2 and 3 above, by suspending a circuit board, first, for three minutes in the boiling sump, which contained the azeotropic mixture, then, for one minute in the rinse sump, which contained the same azeotropic mixture, and finally, for one minute in the solvent vapor above the boiling sump. The boards cleaned in each azeotropic mixture had no visible residue remaining thereon.

I claim:

1. An azeotrope consisting essentially of from 85 to 95 weight percent 2,2-dichloro-1,2-difluoroethane and 5 to 15 weight percent methanol wherein said azeotrope boils at about 44.0° C. at atmospheric pressure; 92 to 98 weight percent 2,2-dichloro-1,2-difluoroethane and 2 to 8 weight percent ethanol wherein said azeotrope boils at about 45.8° C. at atmospheric pressure, or 45 to 55 weight percent 2,2-dichloro-1,2-difluoroethane and 45 to 55 weight percent trans-1,2-dichloroethylene wherein said azeotrope boils at about 44.5° C. at atmospheric pressure.

2. The azeotrope of claim 1, consisting essentially of 2,2-dichloro-1,2-difluoroethane and methanol.

3. The azeotrope of claim 1, consisting essentially of 2,2-dichloro-1,2-difluoroethane and ethanol.

4. The azeotrope of claim 1, consisting essentially of 2,2-dichloro-1,2-difluoroethane and about 45 to 55 weight percent trans-1,2-dichloroethylene.

5. The azeotrope of claim 2, wherein the composition is about 90.5 weight percent 2,2-dichloro-1,2-difluoroethane and about 9.5 weight percent methanol.

6. The azeotrope of claim 3, wherein the composition is about 94.7 weight percent 2,2-dichloro-1,2-difluoroethane and about 5.3 weight percent ethanol.

7. The azeotrope of claim 4, wherein the composition is about 50.2 weight percent 2,2-dichloro-1,2-difluoroethane and about 45.8 weight percent trans-1,2-dichloroethylene.

8. A process for cleaning a solid surface which comprises treating said surface with an azeotropic composition of claim 1.

9. The process of claim 8, wherein the solid surface has a printed circuit board contaminated with flux and flux-residues.

10. The process of claim 9, wherein the solid surface is a metal.

* * * * *